United States Patent [19]

Roman

[11] 4,212,152

[45] Jul. 15, 1980

[54] YARN BLENDING WITH AIR ATTACHMENT ON CONING MACHINE

[75] Inventor: Alfred R. Roman, Greensboro, N.C.

[73] Assignee: Burlington Industries, Inc., Greensboro, N.C.

[21] Appl. No.: 900,340

[22] Filed: Apr. 14, 1978

[51] Int. Cl.[2] ..... D02G 1/16; D02G 3/24; D02G 3/34

[52] U.S. Cl. ..... 57/207; 28/271; 57/6; 57/208; 57/350; 57/245; 57/247

[58] Field of Search ..... 57/140 J, 157 F, 208, 57/207, 350, 245, 6, 247, 209; 28/271–276

[56] References Cited

U.S. PATENT DOCUMENTS

| | | | |
|---|---|---|---|
| 3,113,413 | 12/1963 | Jacobs et al. | 57/208 X |
| 3,309,752 | 3/1967 | Nuissl | 57/157 F X |
| 3,473,315 | 10/1969 | LeNoir | 57/157 F X |
| 3,517,498 | 6/1970 | Beuellier et al. | 57/157 F X |
| 3,812,665 | 5/1974 | Holland | 57/157 F X |
| 3,824,776 | 7/1974 | London, Jr. | 57/140 J |
| 4,051,660 | 10/1977 | Greset, Jr. | 57/157 F X |
| 4,145,869 | 3/1979 | Duncan et al. | 57/208 X |

*Primary Examiner*—John Petrakes

*Attorney, Agent, or Firm*—Cushman, Darby & Cushman

[57] ABSTRACT

The present invention comprises a process for producing a randomized novelty yarn which exhibits essentially no uniform characteristics along its length and a novelty irregular fabric produced therefrom. The novelty yarn is comprised of at least two unlike yarn ends whose different characteristics, when formed into a combination yarn, produce a fabric which is essentially non-uniform and exhibits a random pattern over the length and width thereof.

12 Claims, 17 Drawing Figures

YARN BLENDING WITH AIR ATTACHMENT ON CONING MACHINE

BACKGROUND OF THE INVENTION

The present invention relates to a process for combining together unlike yarns in a manner such that the resulting combined yarn does not exhibit regular and reoccurring characteristics but rather is characterized by being non-uniform.

It is well known that yarns formed from staple fibers, particularly from natural fibers such as cotton and wool, are voluminous and bulky. For many years, various and sundry attempts have been made to produce continuous filament synthetic yarns which have bulkiness characteristics comparable to yarns made from such staple fibers. This is, of course, necessary to produce fabrics characterized by a soft, supple hand, fabrics having better moisture-absorbing characteristics and generally the more desirable aesthetic properties attributable to fabrics made from cotton and wool.

Processes for changing continuous filament yarns into yarns which exhibit a greater degree of bulkiness, resilience, resistance to abrasion, warmth and moisture absorption properties and changed surface texture of such yarns can be broken down roughly into six groups. They comprise texturing with air jets, edge crimping by drawing thermoplastic yarns in a heated and stretched condition over a crimping edge, false-twist texturing which simultaneously twists, heat sets and untwists again, gear crimping, knit-de-knit processing and stuffer box crimping. Each of these methods, in its own way, develops stretch and bulk in continuous filament yarns so that the characteristics of fabric woven or knitted therefrom more closely approximates the characteristics traditionally associated with fabrics constructed from natural fiber yarns.

The above processes by and large dealt with a single end of yarn. Accordingly, another method of increasing the bulk of a final yarn is to combine one yarn with another one commonly referred to as doubling. Doubling can include the combining of several strands of sliver, roving or yarn and when carried out by twisting two or more single ends together, the process is also called plying.

There have, however, been many proposals for combining yarns. Attempts have been made to combine untextured or unbulked yarns and thereafter treating the combined yarn in a false-twist or interlacing device where the yarns themselves have differentially shrinkable components to create a bulky yarn. Such a process is discussed in Maerov et al, U.S. Pat. No. 3,199,281. It should be noted that the intent is to produce fabrics which exhibit uniform dyeability characteristics so that such fabric is reproducible.

Another example of combining two yarn ends together is set forth in Gonsalves et al, U.S. Pat. No. 3,302,386. This invention relates to the production of a tangled yarn and specifically the production of a tangled multifilamentary material from one or more untwisted filamentary yarn ends. The yarns Gonsalves et al is employing are untwisted filaments which apparently have not been textured or otherwise pretreated prior to their being combined.

Collingwood et al, U.S. Pat. No. 3,460,336 also forms a composite yarn structure from dark and light colored yarns so as to produce a novelty yarn having contrasting colors therein. While yarns of different colors are being employed they have not been pretextured or crimped. Rather, it is only after the yarns have been combined that they are crimped, twisted or entangled.

Schroeder, U.S. Pat. Nos. 3,496,714 and 3,605,393 describe and claim a bulky yarn and apparatus for forming that bulky yarn which is in the form of a composite yarn produced from two similar and apparently untreated yarns. The yarns are removed from packages and alternately overfed to a fluid jet which tends to form the particular yarn being overfed, at any particular instant, into the effect yarn while the yarn being normally fed would become the core yarn. Overfeeding of the two yarns alternates back and forth between the two yarns, so that each yarn alternately forms the effect portion and thereafter the core portion of the combination yarn. Thus, the bulkiness of the combined yarn relies upon the out of phase relationship of the two yarns as combined as well as the bulkiness given to the otherwise untextured yarn by the jet.

Other processes, such as described in U.S. Pat. No. 3,501,819, have directed the use of air jets to cause complete entanglement of one, two or more multiple filament yarns so that when combined, each of the multifilament yarns looses its individual identity within a single texturized end.

An additional example of an intermingled multifilament yarn is described in Bunting et al, U.S. Pat. No. 3,110,151 which has as its primary objective the production of a coherent compact multifilament yarn having substantially zero twist in the yarn bundle wherein the individual filaments are intermingled with adjacent filaments. The patent describes a process for dealing with filaments of freshly formed or drawn yarn and does not contemplate a process which would employ precrimped or otherwise pretextured yarns as does the present application.

Processes and jet nozzles for uniformly entangling and intermingling textured yarns are also disclosed in London, Jr., et al, U.S. Pat. No. 3,911,655 and Blanc et al, U.S. Pat. No. 3,958,310.

SUMMARY OF THE PRESENT INVENTION

As indicated previously hereinbefore, the main purpose of the present invention is the production of a combination yarn which essentially has, in terms of yarn characteristics, built in non-uniformity along its entire length. It is well understood in the textile industry that the main objective with respect to the production of yarns and specifically fabrics produced therefrom, is to obtain fabrics which are for all intents and purposes fully reproducible. Thus, it is most desirable and in many instances a requirement, that one can produce uniformly characteristic yarns so that fabrics made therefrom are, after dyeing and finishing, also uniformly characteristic. Any other result was not looked upon as being either desirable or even tolerable. In fact, with respect to the patents discussed above, while some of them refer to intermingling within yarns as being random, the underlying theme in each of those patents was uniformity and reproducability. The yarns produced were designed so as to ultimately be uniform in their characteristics relative to dyeing and finishing procedures when knit or woven into fabric form.

A review of those same patents indicates that the yarns produced have a major physical characteristic appearance along their length. Some are comprised of fibers which are essentially parallel, while those which have been plied appear to exhibit within the combined yarn a barber pole type of effect. Other combining processes tend to effectively destroy individual characteristics brought into the combination by each of the individual yarns whereas still other processes effectively result in the creation of core and effect type yarns.

The yarn resulting from the present process, on the other hand, exhibits most if not all of these various physical characteristics including parallel fibers, areas where the yarns are plied, other areas where the yarn seems to be similar to a core and effect yarn or still other places where the filaments are so effectively intermingled the individual characteristics of the two yarns are lost. The yarn produced by the process according to the present invention, seems to be one which contains characteristics similar to many different yarns which characteristics vary among these types along the length of the yarn in a relatively random and uncontrolled fashion.

The present process contemplates the production of a unique combination yarn comprised of at least two unlike yarns selected from the following groupings:

[a] false-twist textured continuous filament yarns which may be of the stretch, modified stretch, or set family, primarily selected from a polyamide (nylon) and polyester family;

[b] spun yarns of natural fibers, synthetic fibers and mixtures or blends thereof;

[c] continuous filament polyamide and polyester yarns of the knit-de-knit family.

It will be appreciated that these above three groupings comprise yarns which are produced from very diverse sources and it has been discovered that at least two yarns from these groups can be uniquely combined through the modified application of a particular interlacing jet when used together with conventional coning machines during the coning process.

The invention will be more fully understood by reference to the accompanying drawings showing the apparatus employed in the process and various segments of yarn produced by that process wherein.

Figure 16:
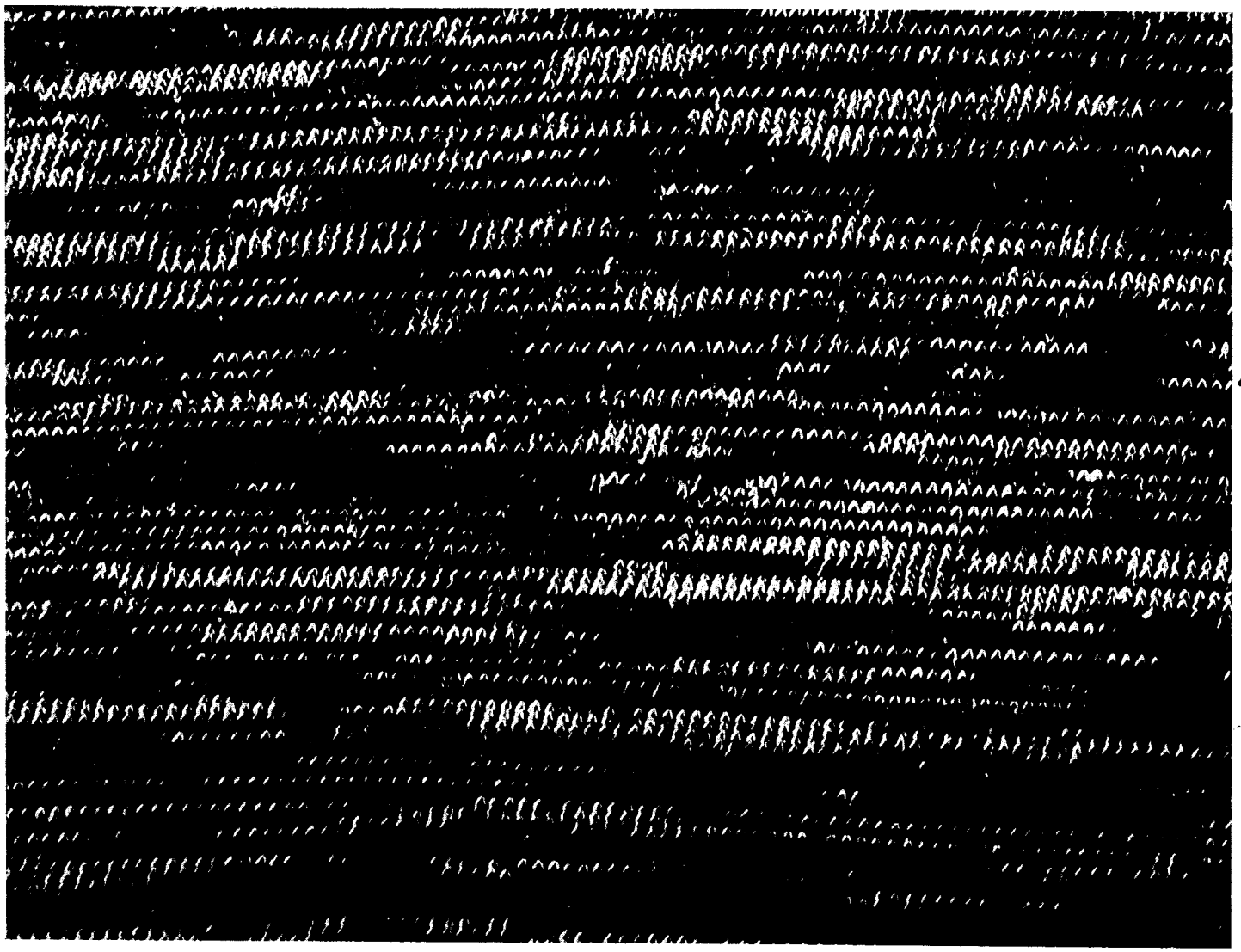
Figure 17:
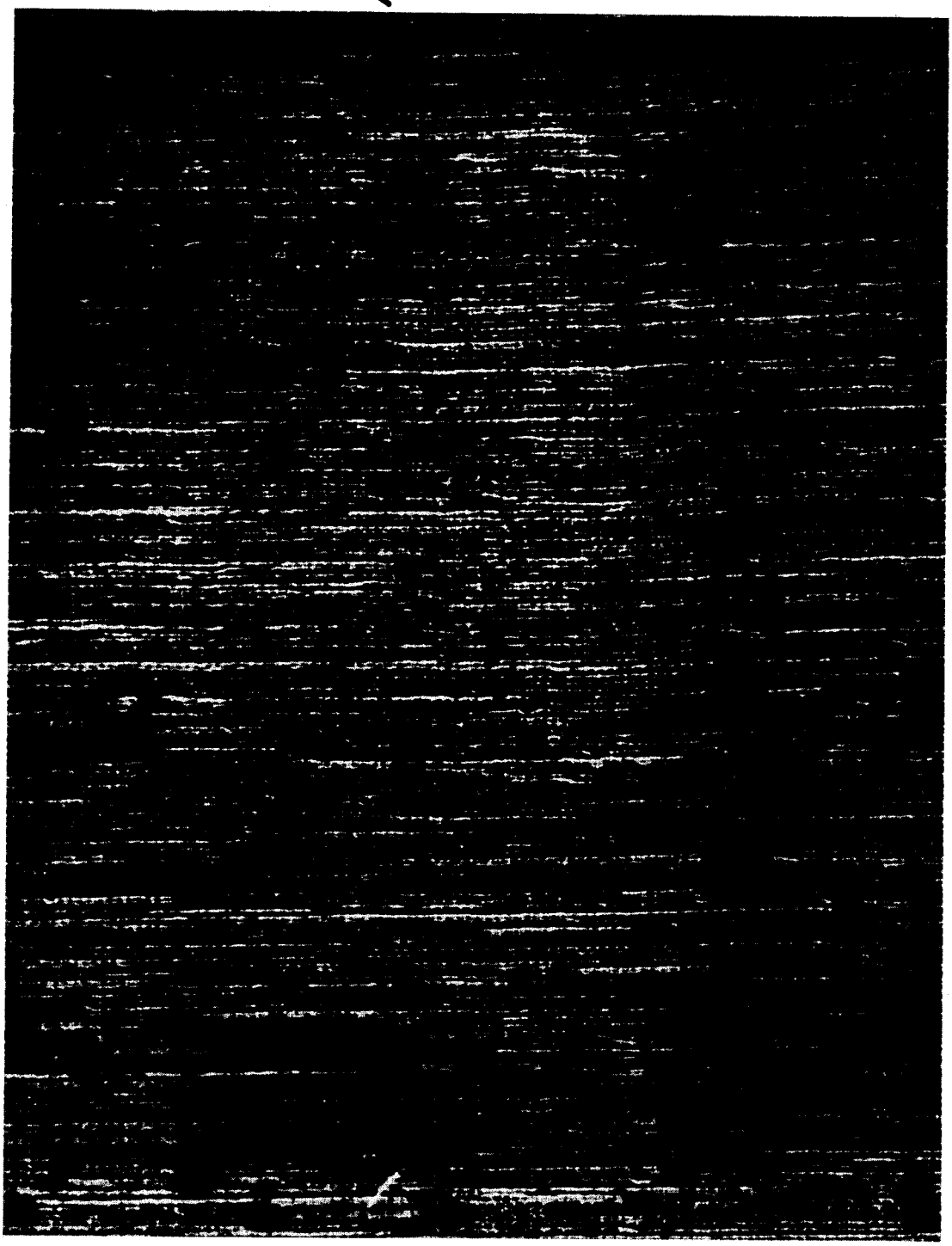

FIG. 16 diagrammatically shows a fabric knit from yarn produced according to the present invention;

FIG. 17 diagrammatically shows a fabric woven from yarn produced according to the present invention.

Figure 1:
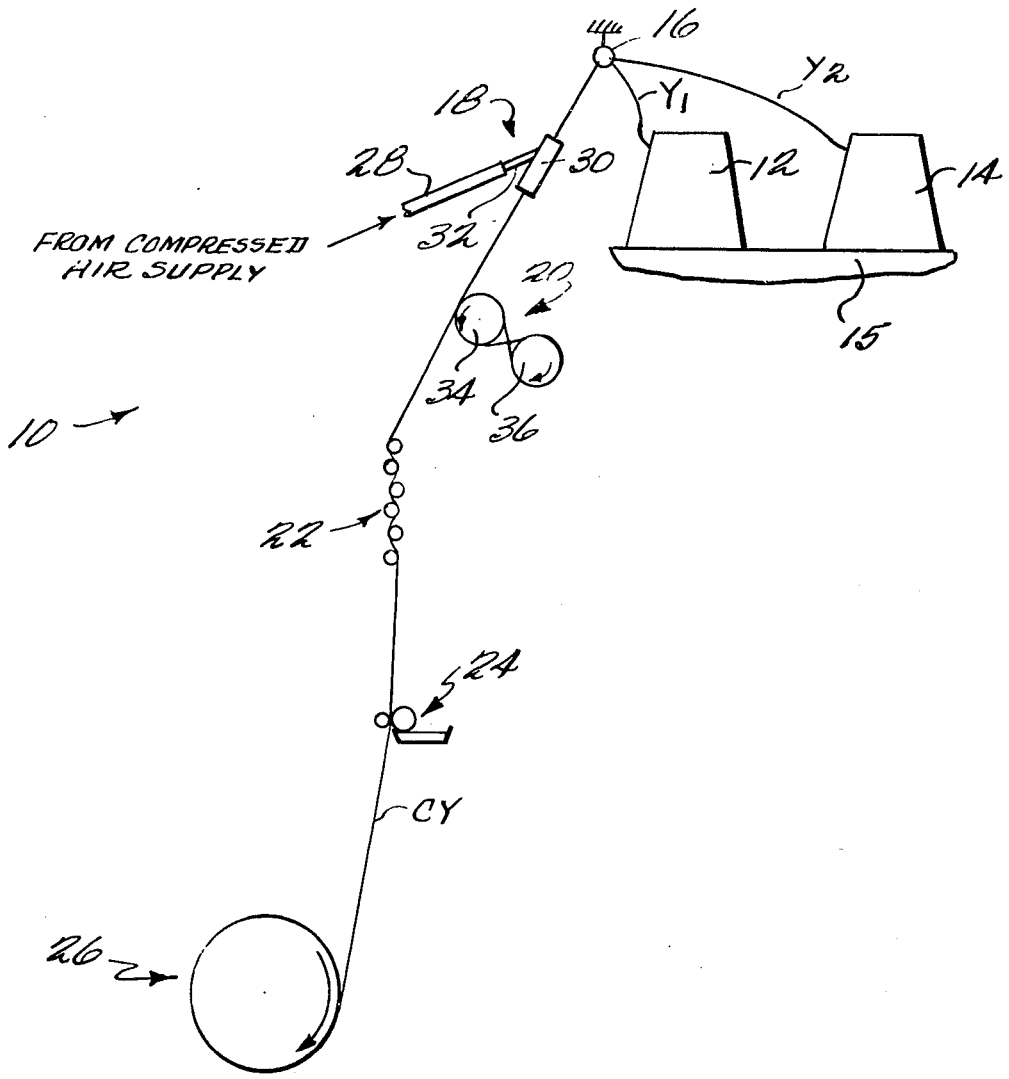
FIG. 1 is a diagrammatic showing of the apparatus used in practicing the present invention.

Turning now to FIG. 1, the preferred arrangement of the apparatus is generally indicated by the numeral 10. Two supply packages 12 and 14 respectively are supported on the coning machine and serve to supply two different types of yarns, for example a spun yarn and a knit-de-knit yarn. Exemplary of the type of coning machine that can be used in the present process is a Conorapid Precision Cone Winder, type K or type L, manufactured by ALU Color FMN Schuster and Co. located at 5032 Efferen/Koln, West Germany. Such machines are distributed in the United States by Custom Industries, Inc. located in Greensboro, N.C. Yarn which is taken from packages 12 and 14 is threaded through a suitable thread guide 16 through the jet assembly generally indicated at 18 around the feed roll assembly generally indicated at 20, a thread guide generally indicated at 22 through an oil applicator generally indicated at 24 and then directly to a take-up package generally indicated at 26.

The jet assembly 18 is comprised of a fluid supply conduit 28 which is connected to the body of the jet 30 by means of a connecting member 32. Examples of the preferred type of interlacing jets which can be used in the present process can be found in U.S. Pat. Nos. 3,824,776, 3,911,655, and 3,972,174. Therefore, with respect to the structure and components of the jet assembly 18 it is felt that further discussion thereof in this application will not be necessary in order to provide a full and clear description thereof to persons skilled in the art. It should be noted, however, that it is essential to use the jet assembly 18 so that it performs in a countercurrent flow with respect to yarn flow through the apparatus. It has been found that the use of jets which operate in a cocurrent fashion with yarn flow will not work on satisfactorily to properly produce the improved yarn described herein when employing coning machines such as the Conorapid machine referred to previously. If the jet were operated cocurrently with the yarn flow, the yarn feed would be too rapid and would not be properly handleable or controllable by the feed roller assembly 20 and the yarn would be forced off of those feed rollers. However, by mounting the jet so that it operates in a countercurrent fashion with respect to yarn flow, yarn can be properly produced and the feed roll assembly 20 can effectively perform its function of both aiding in the pulling of the yarns from packages 12 and 14 and supplying yarn under appropriate tensions to the gate assembly 22 and the take-up package 26.

The feed roll assembly 20 is comprised of feed rolls 34 and 36 with the rotation of rollers 34 and 36 being controllable. Such feed roll units are conventional devices and the above identified Conorapid Winder includes its own feed roll units which are of a conventional design.

It should be pointed out that the feed roll assembly 20 must have the capability of providing at least a slight amount of overfeed to the apparatus generally indicated at 10 at least in the area between the feed assembly 18 in a countercurrent fashion, a certain amount of tension will be placed on the yarn. Therefore, in order to be able to control the density of the package 26 being formed, it must be possible to slightly overfeed yarn to the package so that the density thereof can be varied depending upon the type of yarn being produced and the type of yarns being combined. Typically, the tension placed on the yarn can vary from about 0 grams to about 50 grams and preferably from about 20 to about 50 grams with the amount of overfeed being as great as 300% so that packaged densities for packages 26 can vary between 25 to 50 depending, of course, upon the type of yarn being manufactured.

Thus, by treating yarns in the apparatus just described, dissimilar yarns, for example taken from among the types listed above, can be combined together to form a unitary combination yarn which exhibits areas where the two yarns are randomly interlaced together at spaced apart discrete intervals of essentially non-uniform lengths.

The jet assembly 18 is preferably connected to a supply of a compressed fluid, such as air, with the pressures of such fluid ranging between 20 to 50 pounds per square inch gauge. It should be understood, however, that maintaining the operating level of air pressure for respective yarns is important in achieving the proper combining effect and must be varied depending upon the types of yarns being combined. It is believed that air pressure must be increased proportionally to the increase in the denier per filament of the continuous filament yarns being utilized in the process. Examples of specific yarn combinations and processing parameters will be more fully described hereinafter in reference to the description of FIGS. 2–17.

It has also been found to be preferable to operate the coning machine at a constant speed to help minimize the operational variables. Yarn exemplifying a non-uniform structure can be produced where yarn speed is constant although the degree of non-uniformity may be somewhat minimized. Yarn speed through the winder will vary between about 350 to about 1000 yards per minute and at spindle or take-up speeds of 2100 rpm the preferred yarn speed is about 650 yards per minute. It should be understood that yarn speed, however, is based on the average diameter of the take-up package, spindle speed and a given yarn length. Accordingly, it is possible to determine yarn speed using the equation $$YPM = \frac{D \times \pi \times S}{I}$$

where D equals the average package diameter, S equals spindle speed and I equals yarn lengths of 36 inches of yarn.

Exemplary of the types of yarns used in the present invention are spun yarns having counts such as 8/1, 16/1, 18/1, 22/1, 30/1, or 36/1 with fiber types including rayon, acrylics, polyesters, polyester cotton blends and novelty yarns of the nub type. False-twist yarns, or both the set and stretch type, include both nylon and polyester yarns with deniers ranging from 100 to 150 for the set yarns and from 70 to 150 for the stretch yarn. Exemplary of the knit-de-knit yarns used are Antron and polyester yarns. The resulting combination yarn, CY, will have a denier ranging from about 200 to about 800 which, of course, will be dependent upon the yarns being combined with a preferred range of about 230 to about 450.

The chart set forth below has been coordinated with FIGS. 2–15 and serves to set forth the particular details concerning various yarns being combined in accordance with the procedures set forth herein. Included is an explanation of the type of yarns being combined, the deniers thereof as well as the resulting denier of the combined yarn and the pounds per square inch gauge used in the jet assembly 18 to produce the combined yarn. The yarn speed in each of these instances has been about 650 ypm at a spindle or take-up speed of 2100 rpm and it should be understood that such a yarn speed is exemplary and that other yarn speeds may well be used. The tension listed on the chart for each of the combined yarns made in FIGS. 2–15 varied between 0 and 50 grams and will be varied to provide different densities within the take-up packages 26. Finally, the chart sets forth the average of the frequency of interlaces or tacking points noted in each yarn per yard and per inch along the length of the resulting combined yarn.

CHART

| FIG. | Yarn Types Combined | Deniers of Individual Yarns | Denier of Combined Yarn | PSI Each Jet | Yarn Speed | Tension Between Feed Roll and Package | Frequency of Tacks or Intermingling Yd/Inch | |
|---|---|---|---|---|---|---|---|---|
| 2-3 | FT Tex. St. Nylon KdK Antron #2 | 140/34 Brt.St. Nylon & 140/34 Brt. KdK Nylon | 317 denier or 16.77/1 c.c. | 20 | About 650 ypm | 0–50g. Varies with Density of Package | 29.00 (24.0–36.0) | .806 (0.666–1.00) |
| 4-5 | FT Tex.St.Nylon Spun Acrylic #7 | 100/34 S.D. St. Nylon & 18/1 Acrylic | 412 denier or 12.9/1 c.c. | 30 | About 650 ypm | 0–50g. Varies with Density of Package | 46.20 (37.0–58.0) | 1.283 (1.028–1.611) |
| 6-7 | FT St.Polyester Spun Synthetic | 75/36 St.Poly & 30/1 Poly | 252.2 denier or 21.2/1 c.c. | 30 | About 650 ypm | 0–50g. Varies with Density of Package | 61.50 (55–68) | 1.708 (1.528–1.889) |
| 8-9 | FT Mod.St. Spun Nat/Syn blend Magiloft Polyester | 75/36 S.D. Magiloft Poly & 36/1 Poly/Cotton (50/50) | 227.0 denier or 23.4/1 c.c. | 30 | About 650 ypm | 0–50g. Varies with Density of Package | 65.90 (56–76) | 1.831 (1.556–2.111) |
| 10-11 | FT Mod.St. KdK Polyester Magiloft Polyester | 135/50 Brt.Magiloft Poly & 135/50 Brt. KdK Poly | 234.0 denier or 22.7/1 c.c. | 20 | About 650 ypm | 0–50g. Varies with Density of Package | 40.40 (27.0–47.0) | 1.122 (.750–1.306) |
| 12-13 | KdK Polyester | 150/32 KdK | 326.0 denier | | | 0–50g. | | |

CHART-continued

| FIG. | Yarn Types Combined | Deniers of Individual Yarns | Denier of Combined Yarn | PSI Each Jet | Yarn Speed | Tension Between Feed Roll and Package | Frequency of Tacks or Intermingling Yd/Inch | |
|---|---|---|---|---|---|---|---|---|
| | Spun Nat/Syn blend | Poly & 30/1 Poly/Cotton (50/50) | or 16.30/1 c.c. | 30 | About 650 ypm | Varies with Density of Package 0–50g. | 56.3 (52.0–62.0) | 1.564 (1.444–1.722) |
| 14-15 | KdK Polyester Spun Syn | 150/32 KdK Poly & 30/1 Spun Poly | 353.0 denier or 15.1/1 c.c. | 20 | About 650 ypm | Varies with Density of Package | 49.0 (46.0–53.0) | 1.36 (1.278–1.472) |

As indicated before, yarns produced by the present process exhibit various combinations of yarn characteristics which vary randomly along their entire length. Some of the yarns include areas where the combined ends appear to have been plied, or intermingled to the point where the individual yarns lose their separate characteristics, other areas where the individual yarns appear to lie adjacent one another in a relatively parallel relationship and/or other areas where the combined ends appear to exhibit a core and effect relationship. Examination of relatively long lengths of the yarns produced according to this invention have shown that there is a generally spiral relationship existing between the ends being combined and that this spiral tends to all be in one direction notwithstanding that at points along the lengths the two yarns are intermingled or tacked together.

Figure 3:
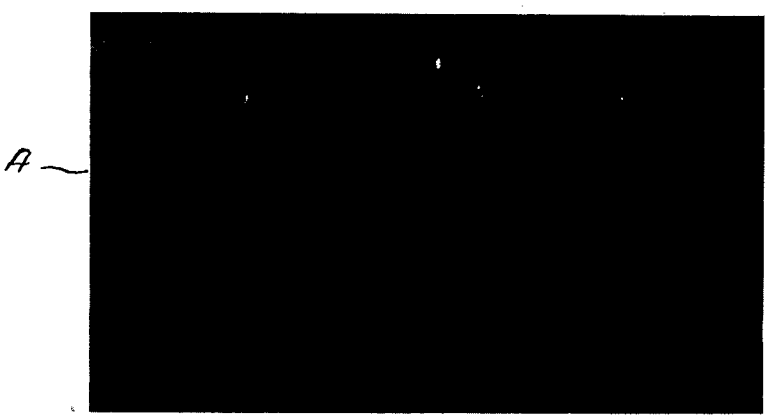
FIG. 3 is a photograph enlarging a segment of the yarn shown in FIG. 2 to a 10× size.
Figure 2:
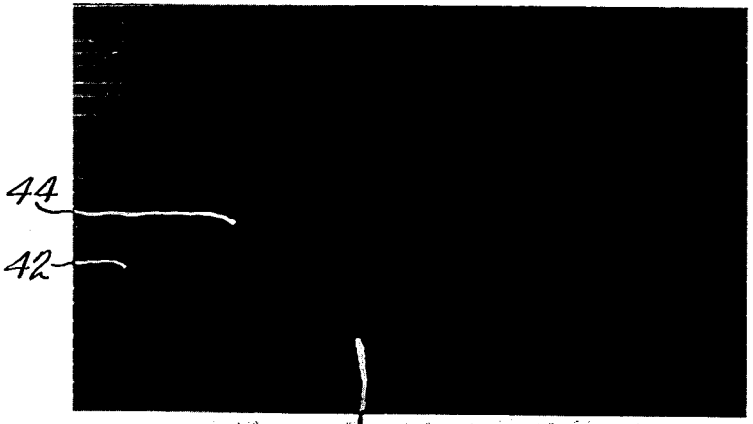
FIG. 2 is a photograph of a composite yarn comprised of false-twist textured stretch nylon yarn and a knit-de-knit Antron yarn.

Turning to FIGS. 2 and 3 the composite yarn A, as shown, was produced from a 140/34 false-twist textured stretch nylon yarn and a 140/34 knit-de-knit Antron yarn with the resulting denier of the combined yarn being approximately 317. The jet was operated at 30 pounds per square inch fluid pressure and with a yarn speed of about 650 ypm with tension on the yarn within the 0–50 grams range. The tack frequency averaged about 29 tacks per yard and actually varied from about 24 per yard to about 36 per yard. The composite yarn A exhibits areas where it is relatively bulky as at 40, followed, in a random fashion, by relatively tight or dense areas 42.

At still other areas, such as at 44, the two yarns appear to have been merely plied and lie next to one another in a relatively parallel relationship.

FIG. 3 indicates that at least in the enlarged area, the two individual yarns have been combined to the point that each appears to have lost its individual characteristics.

Thus, the combined yarn exhibits a variety of yarn characteristics.

Figure 5:
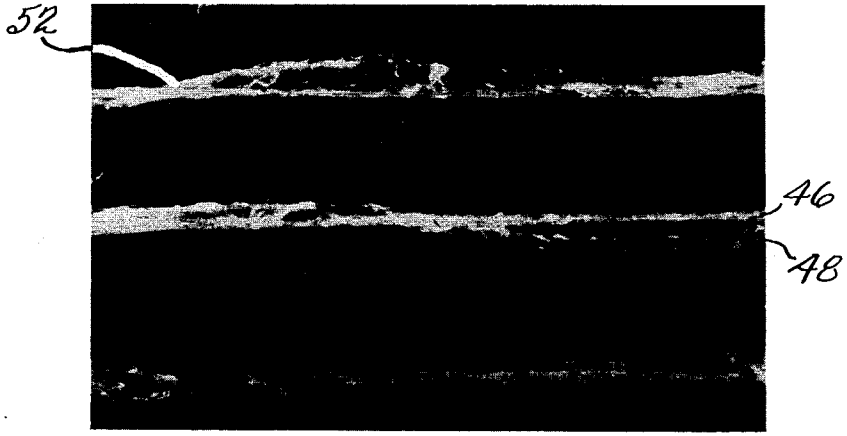
FIG. 5 is a photograph enlarging a segment of the yarn shown in FIG. 4 to a 10× size.
Figure 4:
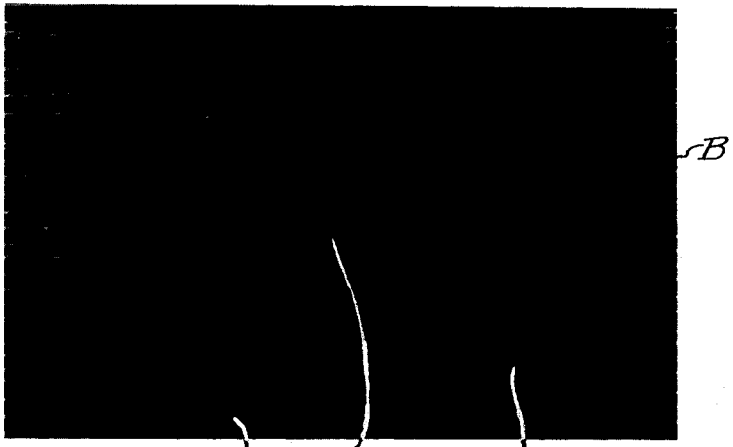
FIG. 4 is a photograph of a composite yarn comprised of a false-twist textured stretch nylon yarn and a spun acrylic yarn.

The composite yarn B, shown in FIGS. 4 and 5, is comprised of a false-twist textured stretch nylon yarn and a spun acrylic yarn, respectively identified in FIG. 5 at 46 and 48. There are places where these two yarns across as at 50 in a manner indicative of a plied product and the yarns are effectively tacked together as indicated at 52 at random points. The tacking appears to be accomplished by the nylon yarn 46 becoming intertwined with or entangled with some of the filaments making up the spun rayon yarn 48. As indicated in the above yarn chart, the frequency of the tacks averaged about 46 per yard. As is clear from FIG. 4, the relationship between the two yarns 46 and 48 is quite random with loops, shown at 54 appearing at some points along the length of the yarn, whereas at other points, as at 56, the yarns appear to lie adjacent each other in a relatively parallel fashion.

Figure 7:
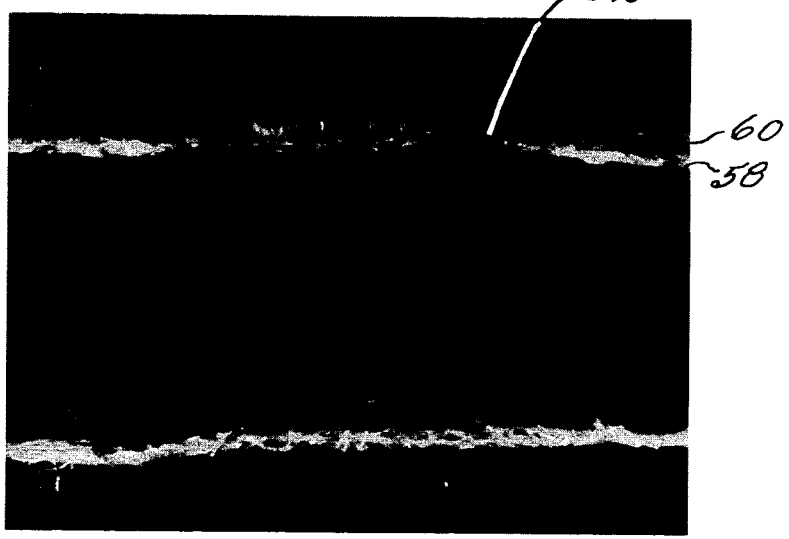
FIG. 7 is a photograph enlarging a segment of the yarn shown in FIG. 6 to a 10× size.
Figure 6:
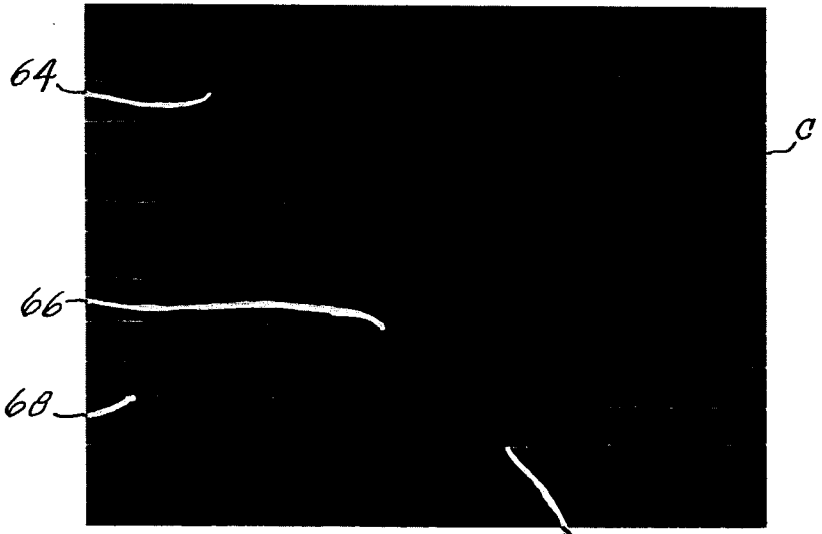
FIG. 6 is a photograph of a composite yarn comprised of a false-twist textured stretch polyester yarn and a spun synthetic yarn.

In FIGS. 6 and 7, the composite yarn C is constructed from a false-twisted stretch polyester yarn and a spun polyester yarn, identified respectively in FIG. 7 by numerals 58 and 60. This composite yarn also clearly exhibits points where the two yarns cross over and are tacked together, such as shown at 62 in both FIGS. 6 and 7. In addition, there are areas in this composite yarn, as was true with the yarn shown in FIGS. 4 and 5, in which loops 64 are formed, other areas where the yarns tend to exhibit a parallel-type relationship as at 66, and still other places where the yarns appear to be plied as at 68.

Figure 9:
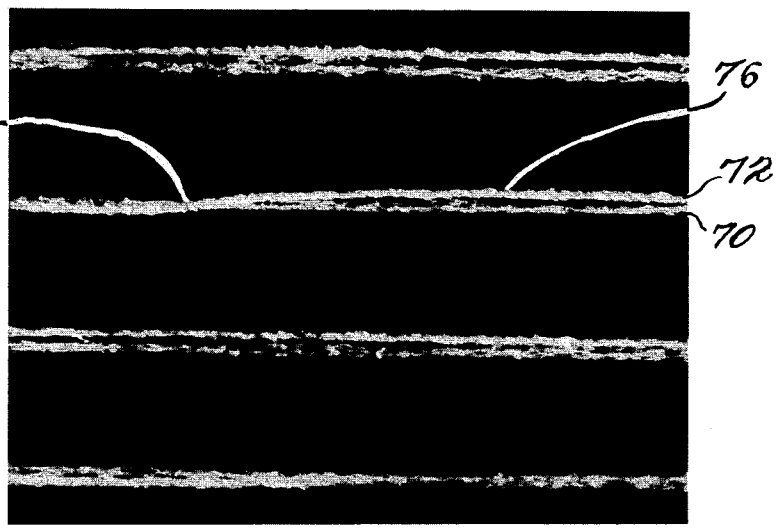
FIG. 9 is a photograph enlarging a segment of the yarn shown in FIG. 8 to a 10× size.
Figure 8:
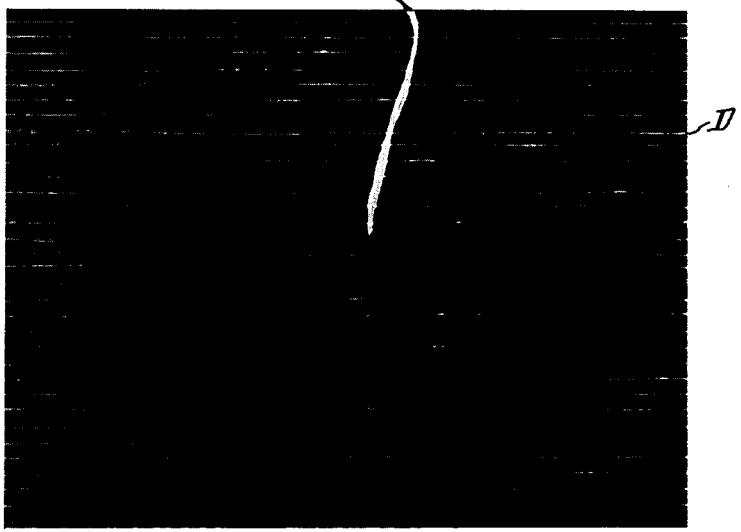
FIG. 8 is a photograph of a composite yarn comprised of a false-twist textured modified stretch Magiloft polyester yarn and a spun polyester and cotton blended yarn.

In FIGS. 8 and 9 composite yarn D is shown and is comprised of a combination of false-twist moderate stretch polyester yarn, Magiloft, indicated at 70 and a knit-de-knit polyester cotton blended yarn 72.

As was true with the yarns just discussed, yarn 70 and 72 have points at which they are tacked together as is indicated at 74 followed by an area 76 where the two yarns appear to lie in a parallel relationship with one another. At other areas in the yarn; loops are formed as at 78 so that here also there are a variety of yarn characteristics appearing throughout the length of composite yarn D. It can also be noted that the tack frequency averaged 65.9 or about 66 tacks per yard with tacks actually varying from about 56 to 76 tacks per yarn. Thus, this yarn was in a highly tacked condition.

Figure 11:
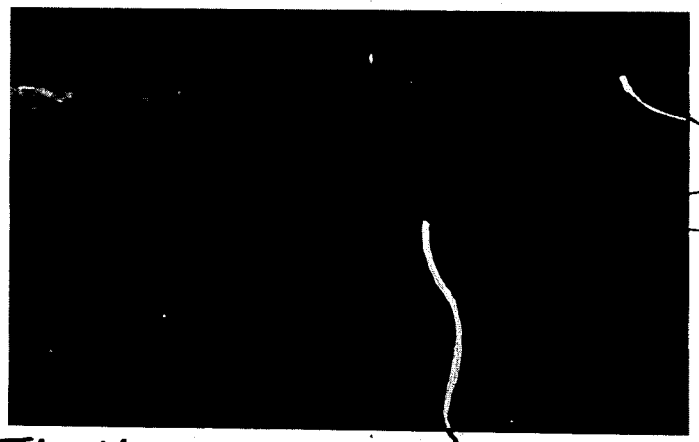
FIG. 11 is a photograph enlarging a segment of the yarn shown in FIG. 10.
Figure 10:
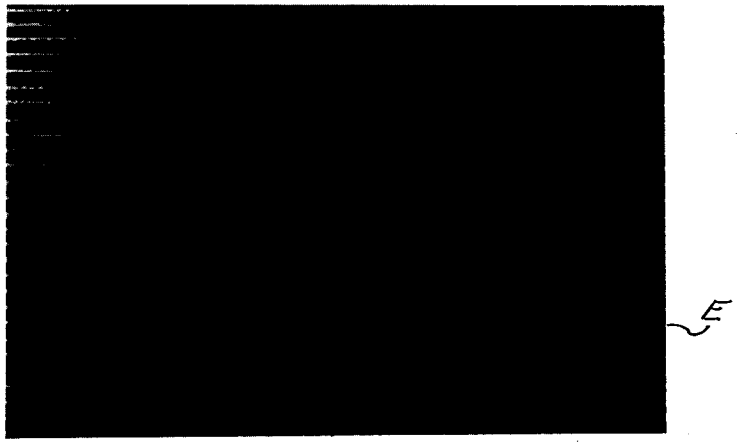
FIG. 10 is a photograph of a composite yarn comprised of a false-twist textured modified stretch yarn and a knit-de-knit polyester yarn.

In FIGS. 10 and 11 the composite yarn E is comprised of a false-twist moderately stretchable Magiloft polyester and a knit-de-knit polyester yarn with the combined yarn having a denier of about 234. Here the jet pressure was reduced to 20 p.s.i. and at the same yarn speeds and tensions, the tack frequency averaged at 40.4 tacks per yarn or 1.122 tacks per inch with the specific range of tacks being 27–47 per yard.

As is indicated at 80 in FIG. 11, the two yarns have been intermingled such that each of the two yarns appear to be lying next to one another as at 82 with the polyester yarn indicated by numeral 84 and the knit-de-knit polyester yarn indicated at 86.

Figure 13:
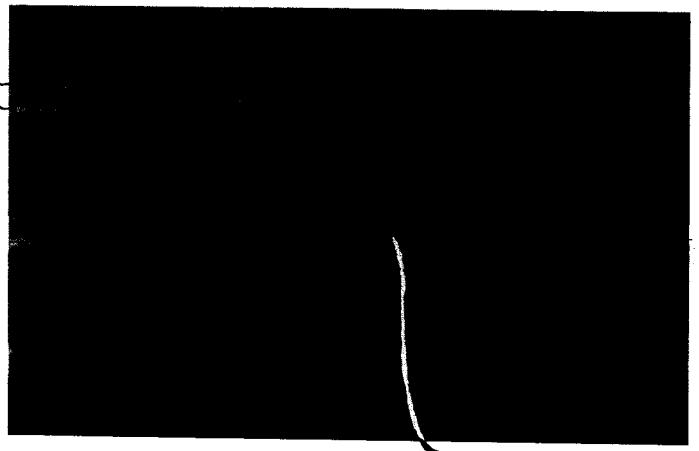
FIG. 13 is a photograph enlarging a segment of the yarn shown in FIG. 12.
Figure 12:
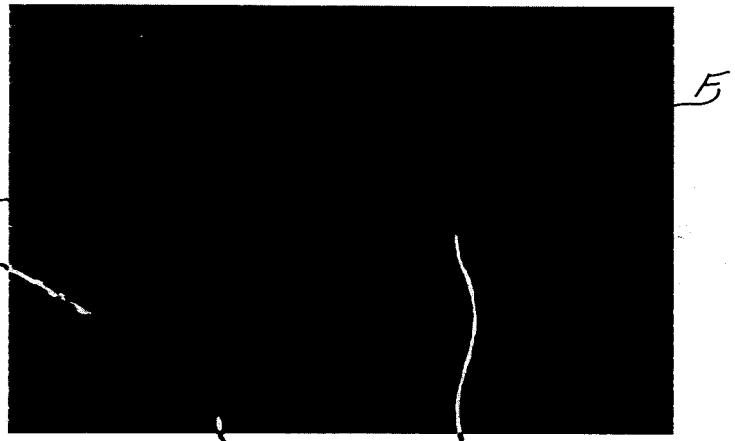
FIG. 12 is a photograph of a composite yarn comprised of a knit-de-knit polyester yarn and a spun polyester and cotton blended yarn.

Turning now to FIGS. 12 and 13, the composite yarn F is comprised of a knit-de-knit polyester yarn 88 and a spun polyester/cotton 50/50 blended yarn 90. The resulting denier of the combined yarn here is 326 denier and with jet pressures again at 30 p.s.i. the tacking frequency was 56.3 and varied between about 52 to about 62 tacks per yard. While the tacks were relatively high, these yarns also appear to have a parallel relationship with one another at some places as is indicated at 92 and exhibit plied characteristics at other areas as at 94 including loops 96. In still other areas, the yarns appear to be intermingled such that their identities are lost as at 98 and tacking points are shown as at 100 in FIG. 13.

Figure 15:
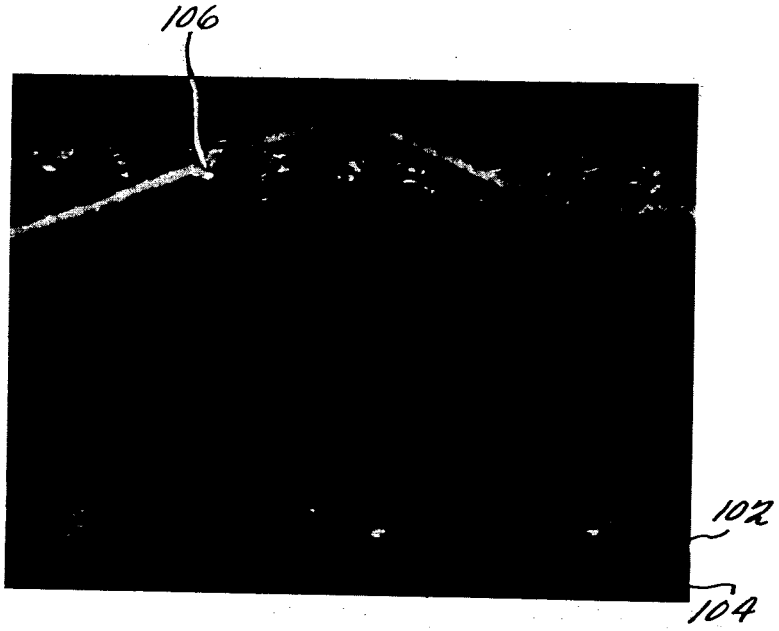
FIG. 15 is a photograph enlarging a segment of the yarn shown in FIG. 14.
Figure 14:
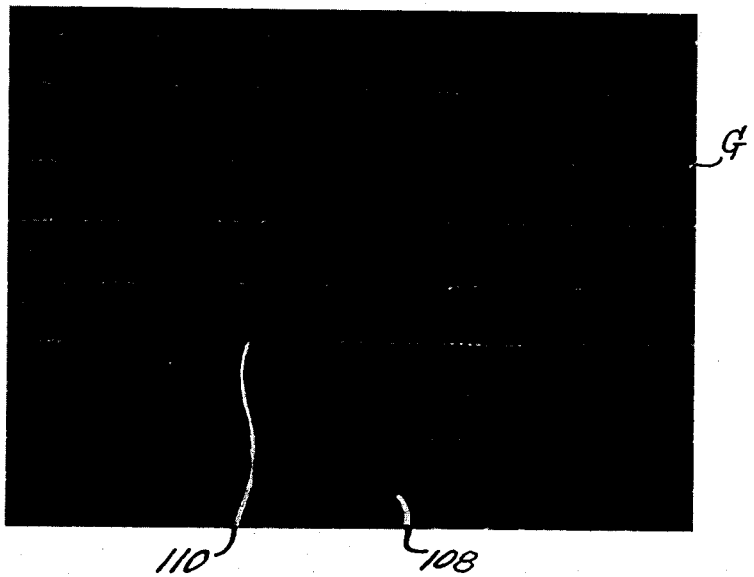
FIG. 14 is a photograph of a composite yarn comprised of a knit-de-knit polyester yarn and a spun synthetic yarn.

Turning next to FIGS. 14 and 15, the composite yarn G is comprised of a knit-de-knit polyester yarn 102 and a spun synthetic polyester yarn 104. These yarns appear to be tacked together in FIG. 15 as at 106 and reference to FIG. 14 shows the formation of numerous loops as at 108. In addition, the portion indicated at 110 appears to show the yarns in a generally plied condition and FIG. 14 shows quite clearly that there is a randomness between the formation of loops and tacking intervals which for this yarn averaged 49 tacks per yard.

FIG. 16 is a photograph of a piece of fabric knit from a combined yarn comprised of a stretch polyester and spun polyester yarn similar to that described in FIGS. 6 and 7 above. This figure clearly demonstrates that a fabric knit from a combination yarn produced according to the present process results in the formation of a fabric that does not have any uniform surface characteristics therein. There appears to be no regularity between the light and dark areas across the face of the fabric shown in FIG. 16 and the fabric includes a wide variety of color characteristics as well as shadings falling inbetween the clearly dark and clearly light areas. Further, the light and dark areas begin and end in a random fashion without any regularity and accordingly produce a fabric which is clearly irregular in nature.

FIG. 17 shows a fabric woven from yarns produced according to the present process described hereinbefore and this fabric, too, exhibits non-uniformity across the surface area thereof. Changes in color appear all across the surface of the fabric and as was the case in the fabric of FIG. 16, the color changes irregularly from light to dark as well as between various shadings therebetween. There appears to be randomness between the areas where light and dark yarns appear and the extent to which they extend across the surface area of the fabric.

From the foregoing discussion, it is clear that dissimilar yarns chosen from false-twist textured continuous filament yarns, spun yarns and knit-de-knit yarns can be combined in a novel fashion to form a single combination yarn which yarns are randomly interlaced or tacked together at discrete intervals essentially in a non-uniform fashion. The resulting combination yarn exhibits yarn characteristics which vary randomly along its length and which are derived from the individual characteristics of the yarns being combined. Also, in those instances where a spun yarn is being combined with a multifilament textured or crimped yarn, whether produced by the false-twist texturing or knit-de-knit crimping approaches, the continuous filaments will be interlaced at random points with the loose fiber ends that extend from the twisted spun yarn. Thus, the present application serves to describe a novel fabric, yarn and process for producing such yarns. The yarns themselves have a degree of non-uniformity built into them such that when used to produce fabrics, either by knitting or weaving as shown in FIGS. 16 and 17, the surface characteristics of those fabrics will, essentially, be unpredictable and vary in color, texture and degree in a random manner.

While the present invention has been described in connection with a preferred process, and the preferred forms thereof, it is to be understood that the present invention is not to be limited to the disclosed embodiments and forms but on the contrary, it is intended to cover various modifications and equivalents thereof included within the spirit and scope of the appended claims.

What I claim is:

1. A process for combining at least two unlike yarn ends wherein at least one is a continuous filament textured yarn to produce a novelty yarn exhibiting essentially no uniform appearance characteristics along the length thereof as a result of the combining of the two unlike yarn ends, including the steps of:

removing each of the two yarn ends from respective supply packages under predetermined tensions;

merging the two yarn ends and feeding the merged ends through an intermingling jet;

flowing a fluid within the jet in a direction countercurrent to the direction of flow of the merged ends so as to effect random intermingling along the length of the merged ends and to create random areas therealong wherein the two yarn ends exhibit a structure varying between parallel, plied, a core and effect like relationship and interlaced with respect to one another;

passing the randomly intermingled merged ends through a yarn feed system located downstream from the air jet; and collecting the merged ends on a take-up package.

2. A process as in claim 1 wherein the yarn ends are being combined during coning.

3. A process as in claim 1 wherein the fluid flowing through the jet is air supplied at pressures ranging from about 20 to about 50 pounds per square inch gauge.

4. A process as in claim 3 wherein the pressure of the air is preferably about 35 psi gauge.

5. A process as in claim 3 wherein the speed at which the yarn is traveling ranges from about 350 to 1000 yards per minute.

6. A process as in claim 5 wherein the preferred yarn speed is about 650 yards per minute.

7. A process as in claim 5 wherein the yarn is collected in the form of packages having densities ranging from about 25 to about 50.

8. A process as in claim 7 wherein the step of passing the merged ends through a yarn feed system includes the step of overfeeding the yarn as it travels between the jet and the point of collection, the overfeeding being at a rate of about 300 percent.

9. A randomized novelty yarn comprised of at least two unlike yarn ends, one of the yarns being a false-twist textured continuous filament yarn, a spun yarn, or a continuous knit-de-knit yarn, the other yarn being one of the two remaining unchosen yarns, said novelty yarn being randomly intermingled along its length so that said novelty yarn does not exhibit substantially any uniform appearance characteristic along the length thereof as a result of the combining of the two unlike yarns and includes random areas where the combined yarns vary between being plied, intermingled so that individual yarn characteristics are masked, parallel and configured as core and effect yarns.

10. A novelty fabric comprised of a randomized novelty yarn which exhibits essentially no uniform appearance characteristics along its length, said novelty yarn being comprised of at least two unlike yarn ends treated in an intermingling jet where fluid flow is counter to yarn flow, one of the yarns being a false-twist textured continuous filament yarn, a spun yarn, or a continuous knit-de-knit yarn, the other yarn being one of the two remaining unchosen yarns, said novelty yarns including random areas where the combined yarns vary between plied, intermingled so that individual yarn characteristics are masked, parallel and configured as core and effect yarns, so that when formed into said novelty fabric and dyed an essentially non-uniform and random pattern is created within said novelty fabric over the length and width thereof.

11. A process as in claim 1 wherein one of the two unlike yarn ends is a false-twist textured continuous filament yarn, spun yarn, or a continuous knit-de-knit yarn, the other yarn being one of the two remaining unchosen yarns.

12. A process for combining at least two unlike yarn ends to produce a novelty yarn exhibiting essentially no uniform appearance characteristics along the length thereof as a result of the combining of the two unlike yarn ends, one of the yarns being a false-twist textured continuous filament yarn, spun yarn or a continuous knit-de-knit yarn, the other yarn being one of the two remaining unchosen yarns, including the steps of:

removing each of the two yarn ends from respective supply packages under predetermined tensions;

merging the two yarn ends and feeding the merged ends through intermingling means;

intermingling the merged ends by passing the ends through an intermingling medium having a flow direction counter to the flow direction of the merged ends to thereby randomly intermingle the merged ends along their entire length creating random areas therealong wherein the intermingled structure includes random lengths where the merged ends are substantially separate and parallel, plied, interlaced, or exhibit a core and effect in a like relationship with respect to one another; and collecting the treated merged ends on a take-up package.

* * * * *